United States Patent [19]

Hargrave

[11] Patent Number: 4,492,307

[45] Date of Patent: Jan. 8, 1985

[54] LEAFLET DISPENSER

[76] Inventor: Malcolm Hargrave, 67 Garden Village, Darwen, Lancashire, England, BB3 2HS

[21] Appl. No.: 590,218

[22] Filed: Mar. 19, 1984

[30] Foreign Application Priority Data

Mar. 25, 1983 [GB] United Kingdom ..... 8308350

[51] Int. Cl.[3] ..... B65D 85/62; H47B 81/00

[52] U.S. Cl. ..... 206/449; 220/22; 206/453; 211/41; 229/42

[58] Field of Search ..... 206/449, 453, 454, 494, 206/321; 229/42; 220/22; 211/41

[56] References Cited

U.S. PATENT DOCUMENTS

| | | | |
|---|---|---|---|
| 1,953,627 | 4/1934 | Overholtz | 206/453 |
| 2,813,633 | 11/1957 | Welling | 211/41 |
| 3,079,028 | 2/1963 | Rosner | 220/22 |
| 3,138,283 | 6/1964 | Peebles | 229/42 |
| 3,194,396 | 7/1965 | Mock | 206/321 |
| 3,294,229 | 12/1966 | McConnell et al. | 206/449 |
| 3,759,395 | 9/1973 | Jublin | 220/22 |

*Primary Examiner*—William T. Dixson, Jr.
*Attorney, Agent, or Firm*—Pearson & Pearson

[57] ABSTRACT

A leaflet dispenser comprises at least three like channel-section members, one or more of which face upwardly to support the bottom edges of the leaflets and one or more pairs of which face inwardly to support the side edges of the leaflets. Each member comprises a base wall, a rear side wall, a front side wall and one or more ribs disposed between and substantially parallel with the side walls. The rib or ribs divide the member into two or more sub-channels into which leaflets may be put so that, although the dispenser can accommodate many leaflets, when only a few leaflets remain they will not bend and slide down into the dispenser. The base wall has slots therein to receive the rib or ribs and front side wall of another member for storage purposes.

9 Claims, 5 Drawing Figures

LEAFLET DISPENSER

Figure 1:
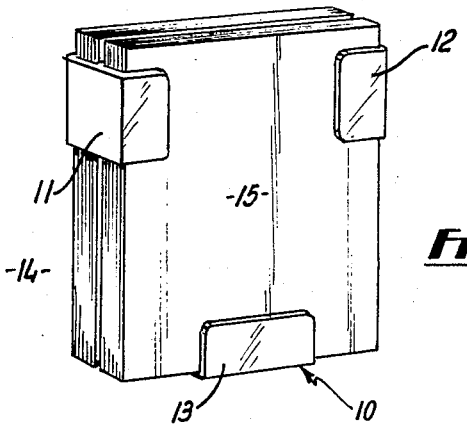

This invention relates to dispensers for leaflets or the like.

In shops, offices, at exhibitions and the like it is customary to have advertising or instruction leaflets, brochures and the like on display so that anyone interested can take one of the leaflets or brochures for further consideration and/or retention. Although such leaflets and the like can be stacked on a table, desk, counter or other flat surface, it is often more convenient and a better utilisation of space to provide a dispenser for such leaflets and the like mounted on a wall or other convenient vertical surface.

Leaflet dispensers of the type comprising an open-topped generally rectangular box are well known. However, with dispensers of this type there is the disadvantage that when only a few leaflets are left in the box they readily bend and slide down into the interior of the box or lie bent over the rim. This is either inconvenient and/or unsightly and readily discourages members of the public from taking a leaflet, thereby possibly having an adverse effect on sales of the product or service to which the leaflet relates. Such dispensers are also relatively costly to produce, bulky to transport and/or store, are suitable in general for only one size of leaflet and can accommodate a limited number of leaflets.

In order to avoid or reduce the abovementioned disadvantages, it is known to provide three or more relatively short lengths of channel which can be secured to a wall with one or more channels open upwardly and two or more mounted above the upwardly open channel(s) and open inwardly. The leaflets or the like are retained in the channels with their lower edges supported in the upwardly open channel(s) and their side edges supported by the inwardly open channels. In this way differing sizes of leaflet can be accommodated by suitable arrangement of the relative positioning of the channels. However, the disadvantage of buckling leaflets remains unless the channels are so narrow as to accommodate only a few leaflets when full. Consequently with such an arrangement the dispenser requires frequent refilling, which is tiresome, or it may remain empty for lengthy periods thereby again possibly having an adverse effect on sales of the product or service concerned.

It is an object of the present invention to provide a leaflet dispenser whereby the aforementioned disadvantages are avoided or substantially reduced.

The invention provides a dispenser for leaflets or the like comprising at least three channel section members of like configuration, having a base wall and two opposed side walls and having on said base wall and spaced from said side walls at least one protrusion extending within said channel to divide said channel into at least two sub-channels.

The or each protrusion may comprise a rib extending substantially parallel with said side walls.

The base wall may be provided with a plurality of apertures of a size and relative disposition to receive therethrough simultaneously the or each protrusion and a side wall of a like channel section member.

The dispenser may be provided with attachment means whereby it may be attached to a wall or like vertical surface. Such attachment means may comprise double sided adhesive pads. Alternatively, especially for securing the dispenser to a loop nylon surfaced panel, the attachment means may comprise "touch and seal" pads such as "Velcro" (Registered Trade Mark).

Figure 2:
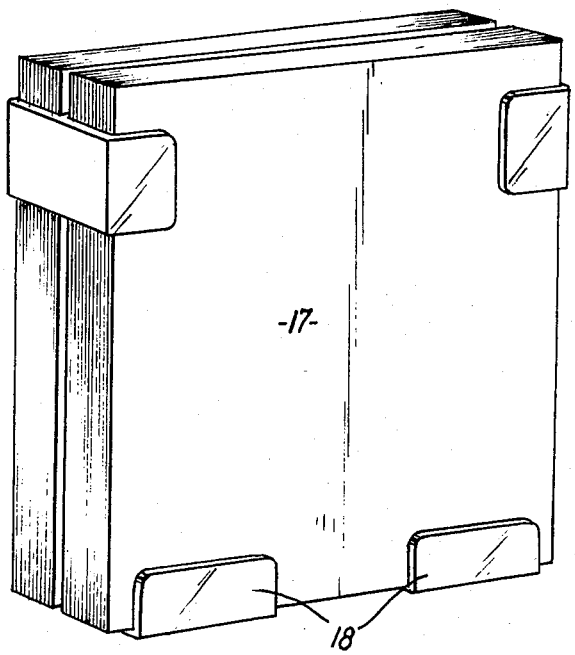
Figure 3:
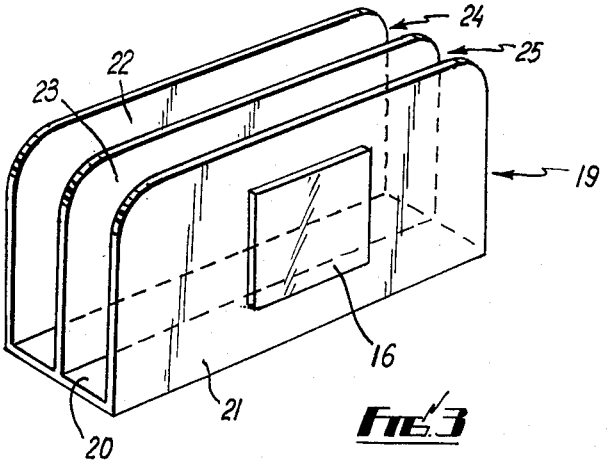
Figure 4:
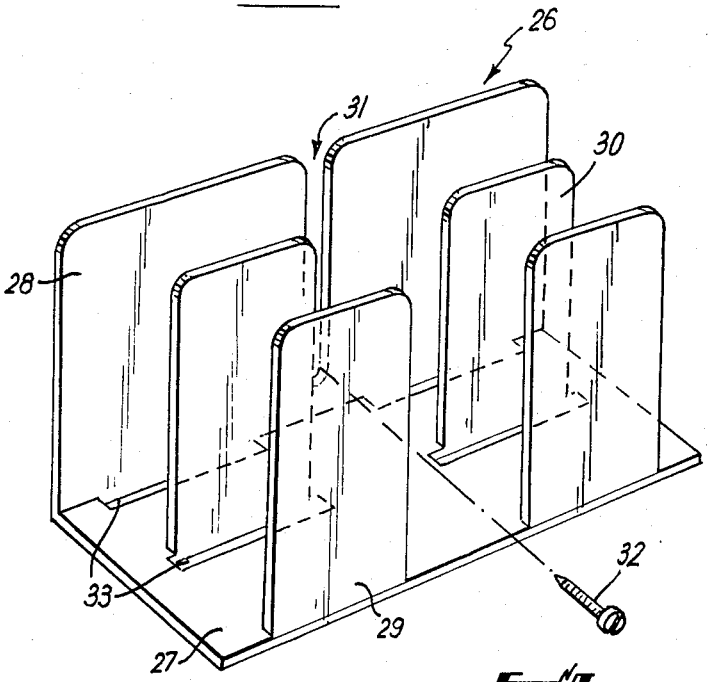
Figure 5:
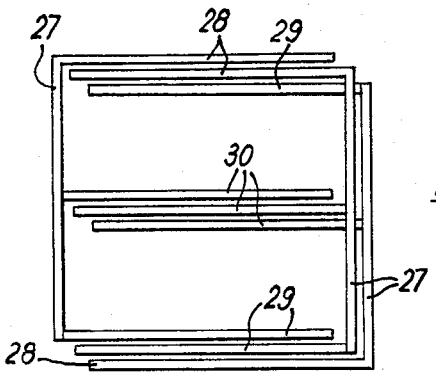

The invention will now be described with reference to the accompanying drawings in which:

FIGS. 1 and 2 are perspective views of a dispenser in use for differing sized leaflets, FIG. 3 is a perspective view of a channel member of the dispenser of FIGS. 1 and 2, FIG. 4 is a perspective view of an alternative embodiment of channel member, and, FIG. 5 is an end view of a dispenser comprising three channel members as shown in FIG. 4 in interdigitating arrangement for storage or transport.

Referring now to FIG. 1 there is shown a dispenser 10 comprising three channel section members 11, 12, 13 secured to a wall 14 so as to retain a plurality of leaflets 15 therein.

The channel members 11, 12, 13 are secured to the wall 14 preferably by double sided adhesive pads 16 (see FIG. 3) although other means of securing the members 11, 12, 13 to the wall 14 may be used. For example if wall 14 comprises a loop nylon surfaced panel such as is customarily used at exhibitions and the like "touch and seal" pads may be secured to the channel members. Alternatively, screws may be used, or pegs attached to or integral with the channel members may be inserted in the holes of a "peg-board" wall structure.

In FIG. 1 the channel member 13 is disposed open upwardly so as to retain the bottoms of leaflets 15 therein. The channel members 11, 12 are disposed above channel member 13 and open inwardly to retain the opposed sides of leaflets 15 therein at locations in the uppermost half of each leaflet. Since the channel members 11, 12, 13 can be readily repositioned on wall 14 leaflets of differing size can be accommodated. As shown in FIG. 2 in the case of relatively large leaflets 17 two channel members 18 may be used to support the bottoms of the leaflets. Although only one leaflet side supporting channel member per side is shown in FIG. 2, two or more per side may be provided if the size of the leaflet 17 requires it.

The channel members of the dispensers shown in FIGS. 1 and 2 are shown in greater detail in FIG. 3. This channel member 19 comprises a base wall 20 and two opposed sidewalls 21, 22, adhesive pad 15 being secured to the outside of side wall 21. On base wall 20 there is provided a protrusion in the form of a rib 23 extending into the channel section to provide two sub-channels 24,25. In the embodiment shown in FIG. 3 the rib 23 is of similar dimensions to side walls 21,22 but the rib 23 may be of other dimensions if desired, in particular it may be smaller than side walls 21, 22. The rib 23 extends parallel with side walls 21, 22 and is disposed mid-way between them so that sub-channels 24, 25 are of equal width. However sub-channels of differing width may be provided if desired. Furthermore two or more ribs 23 may be provided so as to provide three or more sub-channels.

The side walls 21, 22 may be spaced by a relatively large distance so as to accommodate a large number of leaflets. However, by virtue of the construction described herein there is less tendency when there is only a few leaflets in the dispenser 10 for those leaflets to bend or buckle than was the case with dispenser channel members used heretofore of a similar side wall spacing since with the present dispenser the leaflets are retained in a relatively narrow sub-channel 24 or 25. Alternatively a greater number of leaflets can be accommodated in the present dispenser, without increasing the tendency for leaflets to bend or buckle when only a few remain, than was possible with the previously known dispensers.

Referring now to FIGS. 4 and 5 there is shown an alternative embodiment of channel member 26. In this case the channel member comprises a base wall 27, a rear side wall 28, a front side wall 29 and a central rib 30. Rear side wall 28 has a slot 31 therein so that a screw 32 may be used as an alternative to, or in addition to, an adhesive pad or pads 16. This may be particularly advantageous for additional security in the case of the upwardly open channel members 13, 18 of FIGS. 1 and 2, the provision of a slot 31 facilitating withdrawal of the channel member from an injection mould. The rib 30 and the front side wall 29 are each formed as two spaced tongues and adjacent the rear side wall 28 and the rib 30 the base wall 27 is provided with four slots 33. The relative disposition of slots 33 is the same as that of the four tongues forming rib 30 and front side wall 29 so that the tongues of another like channel member 26 can be inserted through the slots 33 as shown in FIG. 5. By virtue of this construction a pack of 3 (as shown in FIG. 5) or 4 channel members 26 can be formed in a neat, compact and convenient way for storage or transportation, each channel member 26 serving to support the other members in the pack so as to resist damage thereto.

The channel members described herein may be made of any suitable material, for example a thermoplastics or thermosetting material. A transparent material may be used, so as to provide a dispenser which is cheap to produce, is reasonably strong and light and does not obscure the leaflets being displayed.

What I claim is:

1. A dispenser for leaflets or the like comprising at least three channel-section members of like configuration, each having a base wall and two opposed side walls and having on said base wall at least one protrusion extending within said channel thereby defining at least two sub-channels.

2. A dispenser according to claim 1 wherein the or each protrusion comprises a rib extending substantially parallel with said side walls.

3. A dispenser according to claim 2 wherein the base wall is provided with a plurality of apertures of a size and relative disposition to receive therethrough simultaneously the or each rib and a side wall of a like channel-section member.

4. A dispenser according to claim 3 wherein one side wall of each channel-section member comprises a plurality of co-planar tongues.

5. A dispenser according to claim 3 wherein the or each rib comprises a plurality of mutually co-planar tongues.

6. A dispenser according to claim 1 wherein the other of said side walls of each channel-section member has a substantially centrally disposed slot therein extending in a direction transverse to the plane of said base wall.

7. A dispenser according to claim 1 wherein each channel-section member is provided with an adhesive pad secured to one side wall thereof.

8. A dispenser according to claim 1 wherein each channel-section member is of a plastics material.

9. A dispenser according to claim 8 wherein said plastics material is substantially transparent.

* * * * *